US006220916B1

(12) United States Patent
Bart et al.

(10) Patent No.: US 6,220,916 B1
(45) Date of Patent: Apr. 24, 2001

(54) TOY BAND WITH PRE-RECORDED MESSAGE

(76) Inventors: Philip D. Bart, 4261 W. McNab Rd., Apt. No. 19, Pompano Beach, FL (US) 33069; Jeffrey M. Herman, 19501 E. Country Club Dr., No. 608, Aventura, FL (US) 33180

( * ) Notice: Subject to any disclaimer, the term of this patent is extended or adjusted under 35 U.S.C. 154(b) by 0 days.

(21) Appl. No.: 09/490,025

(22) Filed: Jan. 21, 2000

(51) Int. Cl.[7] ..... A63H 33/00
(52) U.S. Cl. ..... 446/26; 434/393; 434/395
(58) Field of Search ..... 446/26; 434/304, 434/394, 395, 393; 349/142; 368/163

(56) References Cited

U.S. PATENT DOCUMENTS 5,883,576 * 3/1999 De La Huerga ..... 340/573.1
6,072,392 * 6/2000 Henderson et al. ..... 340/539

* cited by examiner

*Primary Examiner*—Jacob K. Ackun
*Assistant Examiner*—Bena B. Miller
(74) *Attorney, Agent, or Firm*—Malin, Haley & DiMaggio, P.A.

(57) ABSTRACT

A toy band which comprises a bistable spring that can be dynamically deployed from an elongated rigid position to a coiled position around one's wrist, forearm, other part of the body, or any suitably-shaped object through striking the band against that part of the body or object and that also broadcasts a pre-recorded audio message when the band is deployed. The toy band includes an audio broadcast unit removably affixed the bistable spring and includes a housing, a speaker, a battery, an electrical impact switch, and a read-only memory or other memory chip that can store a pre-recorded audio message which is broadcast upon closure of the impact switch. The audio broadcast can be actuated, while affixed to the bistable spring by the striking of the device against any suitably-shaped object, or independently of the spring, by simply removing the unit from the spring and applying pressure to the unit thereby activating the audio messages stored therein.

9 Claims, 3 Drawing Sheets

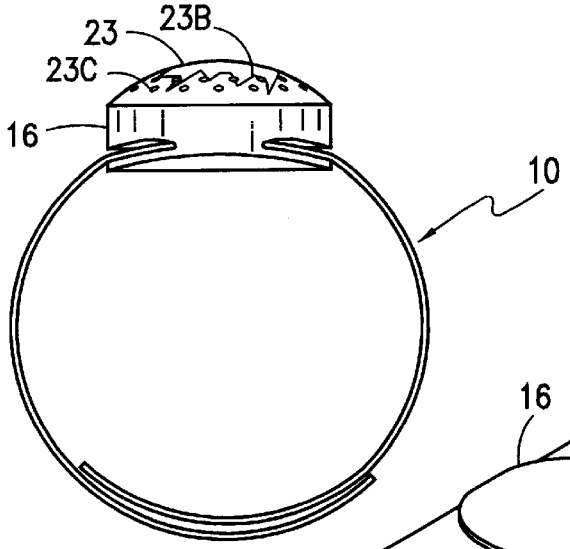
FIG. 5
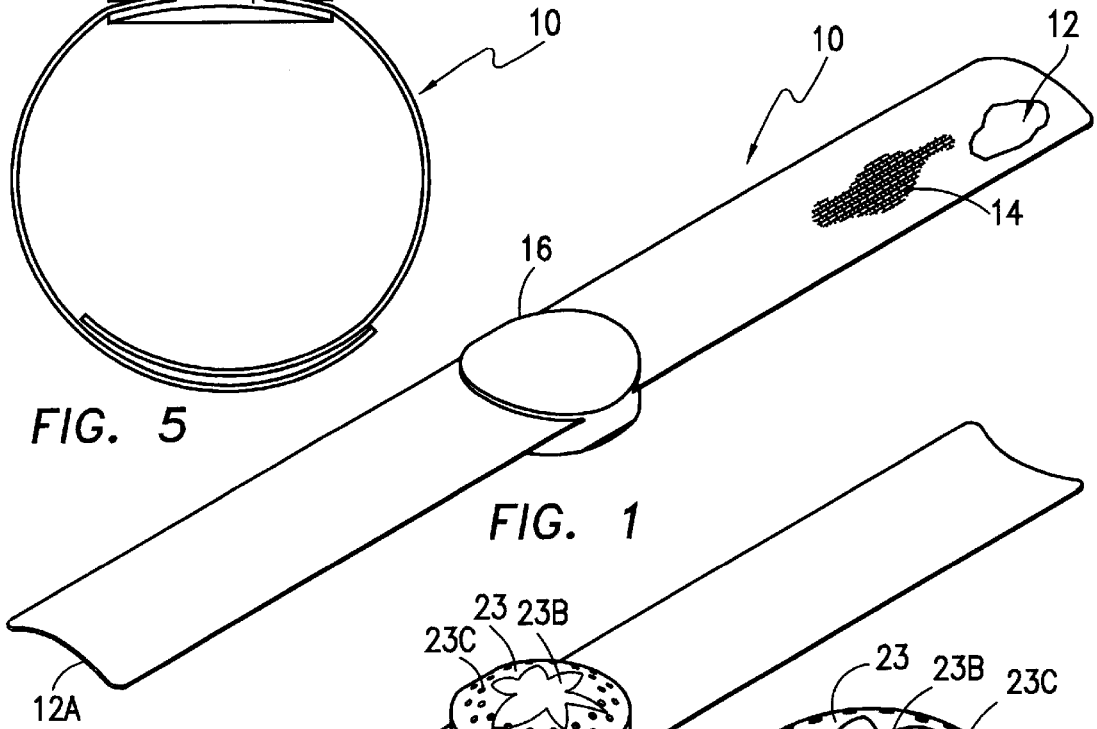
FIG. 1
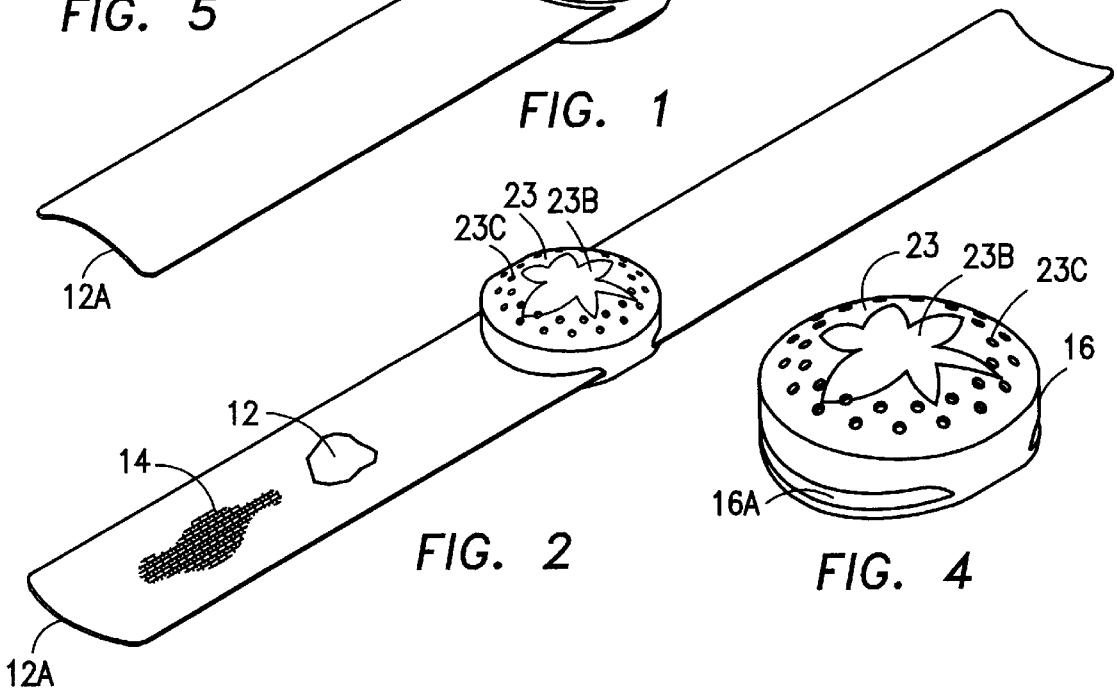
FIG. 2
FIG. 4
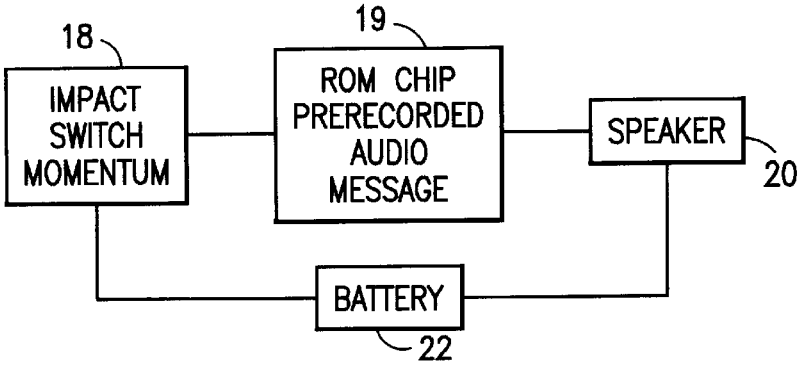
FIG. 3

TOY BAND WITH PRE-RECORDED MESSAGE

BACKGROUND OF THE INVENTION

1. Field of the Invention

This invention relates to a toy band that can be attached to one's wrist, forearm, or other part of the body and dynamically deployed through the spring action of the band, and specifically to a dynamic band that includes a pre-recorded message that is played upon impact with a part of the body as the wrist band is dynamically employed.

2. Description of Related Art

The use of a metal spring band as a wrist band is known in the prior art. Typically, a bistable spring with a fabric or plastic housing that is sized in length to surround the wrist of a wearer has been used as a novelty toy. The bistable spring wrist band has essentially two different physical states or possible positions. One position is elongated and somewhat rigid with the metal spring portion including an arcuate cross-section that houses potential energy that maintains the elongated spring in its semi-rigid position or at least fixed position. The bistable spring wrist band can also be deployed in a second position by impact along the arcuate mid-portion and its mid-section causing the entire spring body to coil up which if done correctly will wrap itself dynamically around the limb of the operator. Such wrist bands have been commercially sold under the Trademark SLAP WRAP™.

The present invention is an improvement over the initial SLAP WRAP™ in that it provides for a more interactive relationship when the operator engages the toy wrist band of the present invention around the wrist, forearm, or other appropriate object. With the present invention, when the toy band is deployed on the wrist through dynamic action, the wearer or operator will also receive a pre-recorded audio message.

BRIEF SUMMARY OF THE INVENTION

A toy band that can be dynamically deployed through dynamic wrapping action around a human's wrist or limb, or other appropriately-shaped object while at the same time broadcasting a pre-recorded message during the dynamic wrapping action. The band comprises a bistable metal spring band sized in length to fit comfortably around the limb of a human being, or around an suitably-shaped object, a fabric coating disposed upon each side of said spring band, and an audio broadcast unit removably attached to said band, said audio impact unit including a speaker, a battery, a pre-recorded audio message residing on a read-only memory chip, and a physical impact switch that activates the battery to provide power to the speaker and the memory chip allowing the pre-recorded message to be broadcast upon activation of the impact switch. The audio broadcast unit may be removed from the bistable band and attached to a belt, body part, or other attachable object for use independently of the bistable band.

The speaker, the battery, and the read-only memory chip containing the pre-recorded audio message are miniaturized and may be mounted in a small housing that includes a fastener having a slotted portion that slides onto the spring band itself. The audio housing would then be mounted approximately along the center of the spring band and cannot come loose. Alternatively, a securing device can secure the audio housing to the band without inhibiting the sensitivity of the impact switch.

The impact switch is positioned along the bottom of the housing and on the side of the housing facing the coiled center direction of the spring. Thus, when the band is dynamically deployed by releasing the spring tension upon impact with the wearer's wrist, for example, causing the spring to coil, at that same moment, the impact switch will strike the wrist causing the pre-recorded message to be broadcast from the speaker.

Thus, when the toy is actually used, a double result from the spring action is encountered. The wearer will get the message broadcast that has been pre-recorded at substantially the same time that the entire wrist band becomes coiled around the wrist, forearm, or other object.

The length of the message can be as desired and may be a short phrase or any type of sound, the purpose of which is to provide a toy or novelty to the wearer. The sound could be broadcast for up to three or four seconds, or as desired.

A design covers the top portion of the audio housing, facing the operator. The design corresponds to the design on the fabric of the band as well as the pre-recorded audio message that is played upon deployment of the invention.

The impact switch may be a pair of spring mounted contacts that are normally kept apart by the metal spring action of the contact holders whereupon the striking of the band upon the impact area would force one of the contacts to engage the other contact and a momentary closure of the switch is sufficient to cause the audio pre-recorded message to be broadcast even when the impact switch is released once the band is stabilized around the impact area. Thus, in one embodiment, the impact switch is important in that it is momentary and requires only a single momentary contact of the two switch elements to turn on the speaker system.

It is an object of this invention to provide an improved novelty toy and wrist band that provides for a dynamic roll-up action as the band is engaged around one's wrist.

It is yet another object of this invention is to provide for a dynamically deployed wrist band that upon deployment upon the user's wrist will broadcast a pre-recorded audio message.

It is yet still another object of this invention is to provide a small lightweight wrist band that can be coiled around, for example, one's wrist, while providing a momentary impact switch that turns on a pre-recorded audio message that is broadcast just after impact as the band deployed on someone's wrist.

It is yet another object of this invention is to provide a dynamically deployable toy band that can engage a human limb or a narrow cylindrically-shaped object.

A further object of this invention is to provide a dynamically deployable toy band that upon coiling around a human limb or a cylindrical object emits light through an LED display as well as audio messages. upon impact of the band upon a human limb or a cylindrical object.

It is still yet another object of this invention to provide a dynamically deployable band that acts as a wrist band for a watch to be used by those who cannot secure a watchband around their wrist, such as people with an arthritic condition.

In accordance with these and other objects which will become apparent hereinafter, the instant invention will now be described with particular reference to the accompanying drawings.

BRIEF DESCRIPTION OF THE SEVERAL VIEWS OF THE DRAWINGS

FIG. 1 shows a bottom perspective view of the present invention.

FIG. 2 shows a top perspective view of the present invention.

FIG. 3 shows a block diagram of the audio message broadcast unit utilizing the present invention.

FIG. 4 shows a top perspective view of the audio broadcast unit used in the present invention.

FIG. 5 shows a side elevational view of the present invention in a coiled position.

PREFERRED EMBODIMENT OF THE INVENTION

Figure 6:
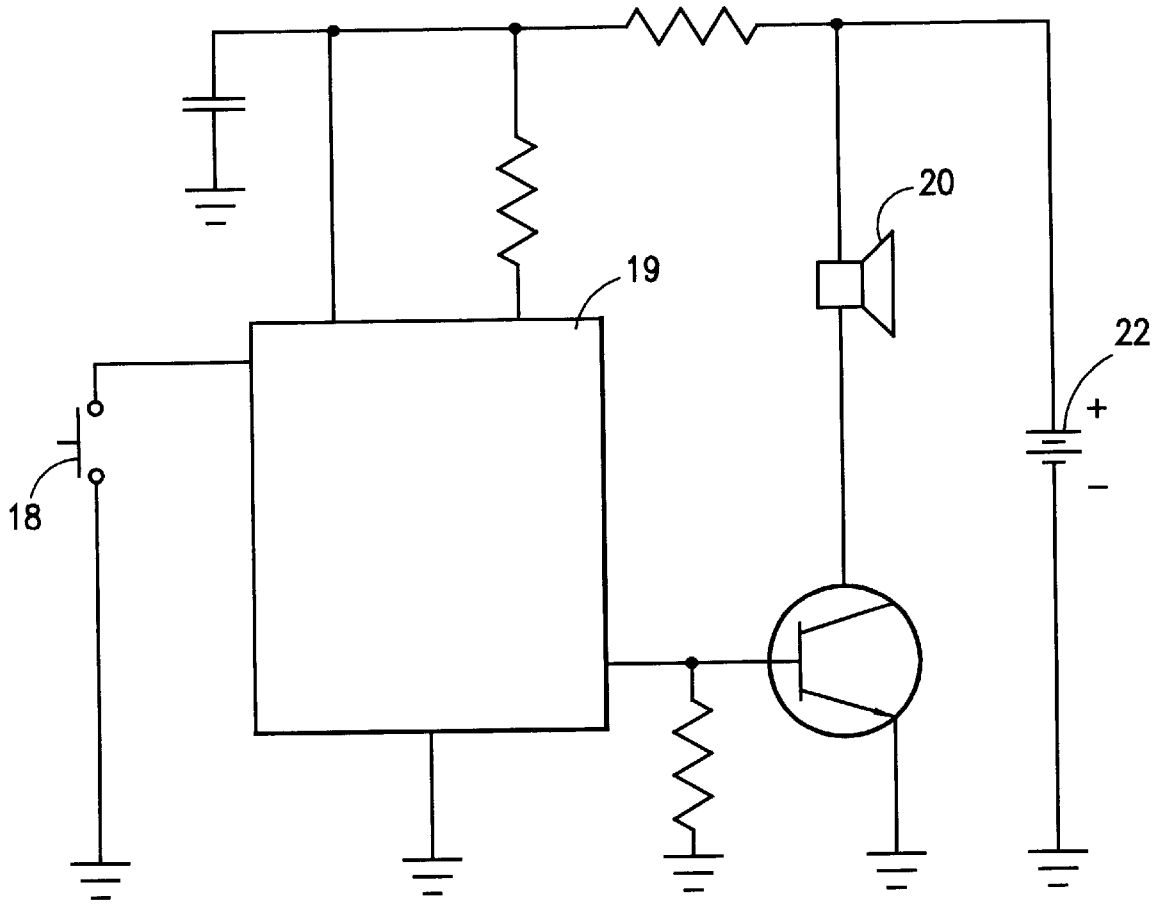
FIG. 6 shows a circuit diagram of the audio message broadcast unit utilizing the present invention.

Referring now to the drawings in particular, FIGS. 1 and 2 show the present invention generally at 10 comprised of an elongated bistable metal spring band 12 which is sized in length to fit around and overlap a wrist, forearm or other body part of a human being and includes an arcuate portion 12A in one position that acts to retain potential energy for dynamically deploying the spring body 12. The band 10 may be covered with a fabric or plastic coating 14 to cover the bare metal or metal appearance of the spring band 12. The spring band 12 is known as a bistable spring that has two positions of operations, or two states of being. The first state is that shown in FIGS. 1 and 2 where it is elongated and substantially rigid.

In its elongated position, the spring band 12 may be six to ten inches long, and preferably about 9 inches long. Preferably, the width of the band is approximately 0.975 inches. Preferably, the arcuate portion 12*a* of the spring band 12 has a radius of approximately 1.195 inches.

Figure 7:
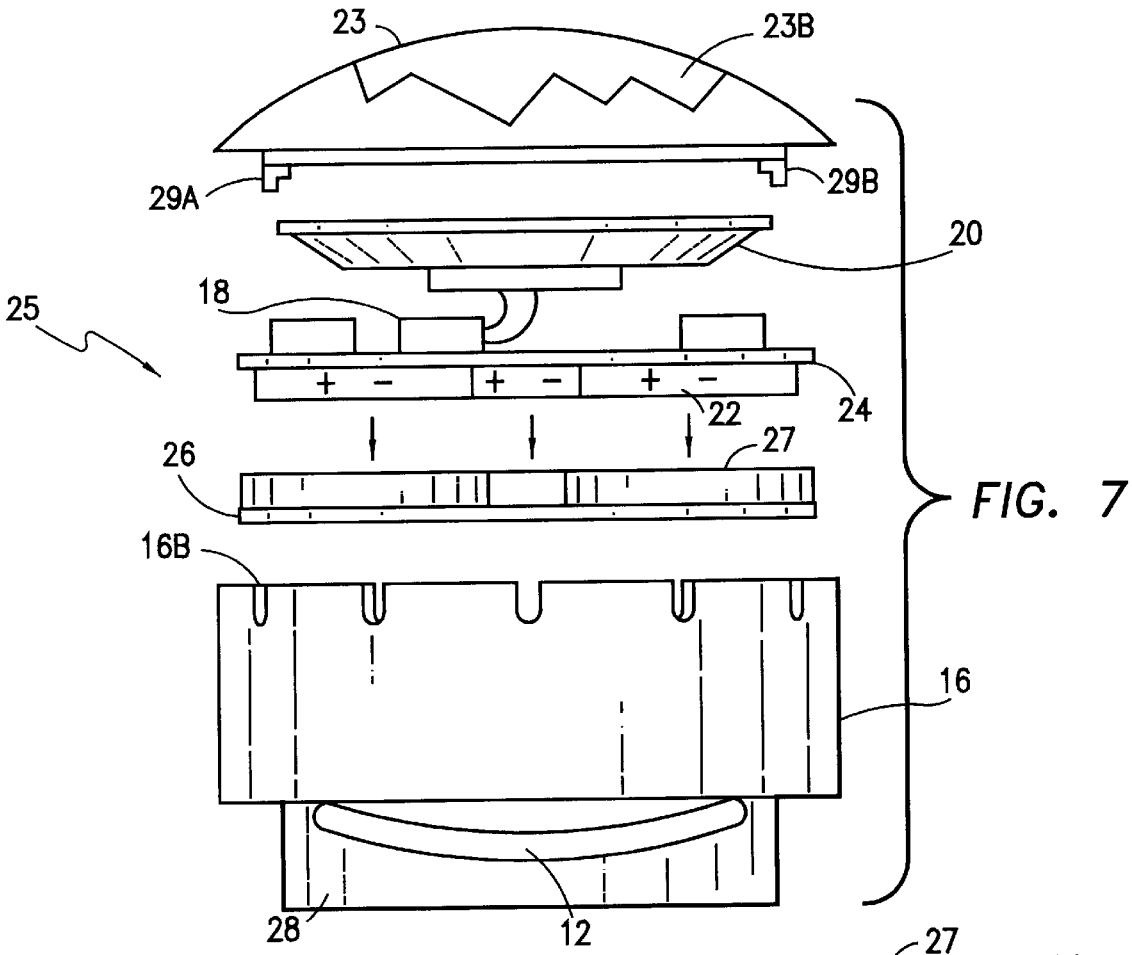
FIG. 7 shows an exploded side view of the audio message broadcast unit of the present invention with the deployable band portion inserted therein.
Figure 9:
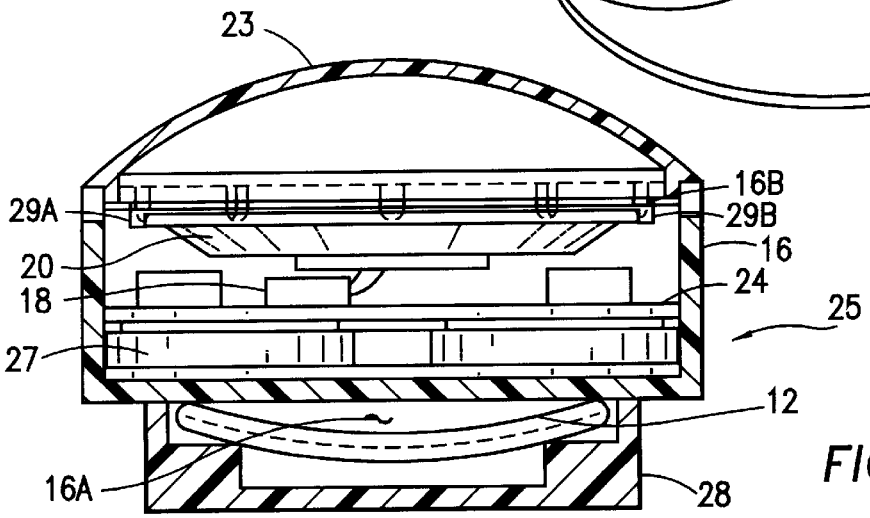
FIG. 9 shows a side cut-away view of the audio message broadcast unit and deployable band of the present invention.

Once the band is dynamically deployed by striking the middle of it against an object such as your wrist or forearm, the entire metal band 12 will coil (as shown in FIG. 5) around the wrist, forearm or other body part of the user. As shown in FIGS. 1 and 2, the spring band 12 also includes a housing 16. An impact switch 18, as seen in block diagram form in FIG. 3, and in conventional form in FIGS. 7 and 9, is enclosed within housing 16, and is activated upon the striking of the housing 16 against an impact area.

As shown in FIG. 2, housing 16 contains a slot 16A which traverses housing 16 at its approximate mid-point although the actual location of the housing 16 along the band 12 may vary. The housing 16 will be positioned such that the spring band 12 can be inserted through slot 16A. The arcuate shape of the spring band 12 provides a natural securing feature which secures spring band 12 to the housing 16 without the need for any additional securing devices. In an alternate embodiment, securing devices may be included to secure the housing to the band.

Referring now to FIG. 3, a block circuit diagram is shown that shows speaker 20 connected electrically to a memory-storage device 19, such as a read-only memory (ROM), having a pre-recorded audio message which itself is electrically attached to the impact switch 18 all of which are attached to batteries 22. Deployment of impact switch 18, which is a momentary switch, once closed, will provide power from the batteries 22 to memory device 19 and to speaker 20 causing the pre-recorded message to be broadcast from speaker 20.

In an alternate embodiment, deployment of the impact switch 18 would close a circuit, which would, in turn, cause the pre-recorded message to play and cause flashing lights to appear on a display situated upon dome 23.

FIG. 5 depicts the present invention after the spring band 12 has been dynamically deployed and is in a coiled position. This is also the second state of existence for the spring band 12 and the bistable spring in its coiled state.

In the preferred embodiment, the diameter of the spring band 12 in its coiled configuration is approximately 1.225–1.250 inches, although this may vary slightly depending upon the initial strength of the spring and the number of times the spring has been deployed. Bear in mind that these dimensions define the diameter of the spring band when it is not wrapped around an object. Of course, if the band is coiled around a wrist, forearm or other cylindrical limb or object, the diameter of the band will be conform to the diameter and shape of the object it is coiled around.

FIG. 6 shows an electrical circuit diagram represented by the block diagram of FIG. 3, indicating the ROM with a pre-recorded audio message 19 stored therein, switch 18, power supply 22 and the speaker 20.

The internal features of the audio broadcast unit 25 will now be described in detail. Referring to FIG. 7, the components of the unit 25 can be seen. Decorative dome 23 resides on the outer surface of housing 16. In the preferred embodiment, housing 16 has a plurality of sound notches 16B situated on the outer periphery of housing 16 to allow for audio signals to emit from the speaker 20 situated within the housing-dome assembly. In an alternate embodiment, as seen in FIG. 2, FIG. 4, and FIG. 2, sound holes 23C are situated on the dome 23.

Dome 23 may comprise a decorative design 23B upon its outer surface, as can be seen by the star in FIGS. 2 and 5. This design corresponds with the audio message or sounds emanating from the speaker 20. For example, a picture of a motorcycle may be the design on dome 23. A corresponding pre-recorded audio message, such as the sound of screeching tires, would then be stored in a ROM chip 19. Preferably, the pre-recorded message or sounds do not exceed 78 decibels, conforming with safety standards. Many other design-audio message combinations are available.

Immediately below dome 23 resides housing 16. Housing 16 includes a speaker 20, a chip 19 having a read-only memory device with a pre-recorded audio message, and one or more batteries 22. A momentary impact switch 18 will activate the batteries 22 which provides power to the ROM chip 19 and speaker 20 causing the message recorded on the read-only memory to be broadcast from speaker 20.

Speaker 20 can be seen in FIG. 7 as residing directly below and within dome 23, to be situated within housing 16. Preferably, the speaker has a diameter of approximately 29 mm. Opposing ribs 29A and 29B secure speaker 20 and assure that sound exits through sound notches 16B, or sound holes 23B, in the alternate embodiment. Chip 19 comprised of a Read-Only-Memory (ROM) device is affixed to a printed circuit board (PCB) 24 which resides immediately beneath speaker 20. The PCB and speaker 20 are enclosed within housing 16.

An impact switch 18 is affixed to the PCB 24 and comes into contact with speaker 20 when the impact switch receives an impact. Any conventional switch common in the industry may be used such as a barrel-spring momentary contact switch, an inertia switch, or a conventional momentary contact switch. One or more batteries 22, are situated on the reverse side of PCB 24. These batteries are electrically connected to speaker 20, impact switch 18 and chip 19 and provide the power to audio broadcast unit 25. Finally, band 12, in its non-deployed state, resides within lower section 28 of housing 16.

Figure 8:
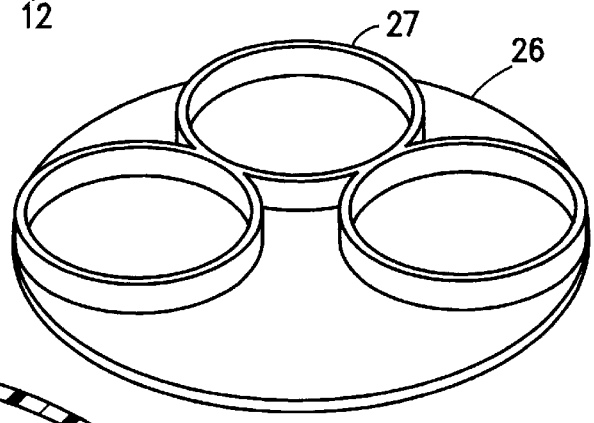
FIG. 8 shows a perspective view of the PCB receiver disk with a plurality of battery holders affixed thereto.

FIG. 8 shows PCB receiver disc 26. FIG. 8 shows how a plurality of walled battery holders 27 are aligned to receive the batteries 22 situated on the underside of PCB 24. The battery holders 27 serve to protect batteries 20 and maintain and align the position of PCB 24 within housing 16.

Referring to FIG. 9, spring band 12 maintaining its arcuate configuration appears in a bottom portion 28 of housing 16.

FIG. 9 shows the audio broadcast unit 25 in a side, cut-away view, with the various internal components, described above, visible. Dome 23 comprises the top portion of the audio broadcast unit 25. In an alternate configuration, notches 16B are formed around the periphery of housing 16 in order to allow the sound to leave speaker 20. Speaker 20 resides immediately below dome 23, and in close proximity to impact switch 18, residing on PCB 24, while band 12 in an uncoiled state, rests within recess 16A, between lower section 28 and housing 16. As an alternate embodiment, impact switch 18 need not reside on the top side of PCB 24, but can be placed underneath PCB 24, or even on the outside of housing 16. However, the advantage of having the impact switch within the housing 16 is to protect the switch from damage.

To use the invention in its preferred embodiment, the user would start with the wrist band in the position shown in FIG. 1. The user would grasp one end of the band and mechanically and dynamically strike the entire band including the audio housing unit against the wrist, the forearm, or other part of the body of the person to whom the band will be attached, which could also be the operator.

Alternatively, the band could be wrapped around any appropriately-shaped object like the arm or leg of a chair. Once the band strikes the wrist or forearm portion, or other body part, the wrist band will coil up and the impact switch will close causing a pre-recorded message to be broadcast and/or flashing lights to appear, at the same time. At this point, the band will be coiled, as in FIG. 5, around the user's wrist, forearm, body part, or suitably-shaped object. To remove the wrist band and to return the wrist band to the elongated rigid state shown in FIG. 1, the user would simply manually pull apart and separate both ends, and snap the spring back to its original state until the band is positioned in the elongated rigid position. The audio broadcast unit can also be easily separated from the bistable spring and actuated independently from the spring upon the striking of the audio broadcast unit upon any object in order to activate the pre-recorded audio message stored therein.

The audio message may contain music, words, or a variety of sounds as desired and are known in the art. The music or sounds emitted by the present invention may be activated by means other than by the procedure described above. For example, the user, after the band has coiled around his or her wrist, can clap their hands, thereby activating the audio message. If the band is placed in the user's pocket, the user can slap his pocket which would also activate the audio message or flashing lights without activating the coiling of the spring.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A dynamically deployable toy band comprising:

a bistable metal spring body sized in length to coil around the limb of a human being or any appropriately-shaped object, and having two states, straight or coiled; and an audio broadcast unit removably connected to said bistable spring body, said unit including a housing, one or more batteries, a speaker, a pre-recorded audio message stored within a memory device, and a switch connected electrically to said batteries, said speaker, and said memory device, such that whenever said impact switch is momentarily activated by striking the human limb, said object, or by being struck thereby changing said bistable spring states, said pre-recorded audio message will be broadcast through said speaker.

2. The deployable band of claim 1 wherein said housing comprises a lower portion containing an aperture traversing horizontally therethrough to allow said spring body to be inserted longitudinally through said aperture wherein said unit is sufficiently positioned at the substantial mid-point of said spring body to prevent said unit from separating from said spring body upon the striking of said spring body upon the human limb.

3. The deployable band of claim 1 wherein a dome portion covers said housing wherein said dome portion contains a decoration.

4. The deployable band of claim 1 wherein fabric covers surfaces of said spring body.

5. The deployable band of claim 1 wherein said switch is an electrical physical impact switch that comprises opposing contact arms and an insulating member situated substantially between said contact arms.

6. The deployable band of claim 1 wherein said switch is a barrel-type momentary contact switch.

7. The deployable band of claim 1 wherein said switch comprises a contact coil wherein upon impact, said coil activates said pre-recorded audio message.

8. The deployable band of claim 1 wherein said audio broadcast unit can be easily separated from said bistable spring for attachment to a belt, body part, or other attachable object, and wherein said audio broadcast unit may be actuated independently from said bistable spring upon the striking of said audio broadcast unit upon any object in order to activate said pre-recorded audio message stored therein.

9. A dynamically deployable noise-making band comprising:

a bistable metal spring body covered by fabric, wherein said spring body is sized in length to coil around the limb of a human being or any appropriately-shaped object, and having two states, straight or coiled;

an audio broadcast unit removably connected to said bistable spring body, said unit including a housing, one or more batteries, a speaker, a pre-recorded audio message stored within a memory device, and an barrel-spring momentary contact switch wherein said switch is connected electrically to said batteries, said speaker, and said memory device, such that whenever said switch is momentarily activated by striking the human limb thereby changing said bistable spring states, said pre-recorded audio message will be broadcast through said speaker;

said audio broadcast unit can be easily separated from said bistable spring and actuated independently from said bistable spring upon the striking of said audio broadcast unit upon any object in order to activate said pre-recorded audio message stored therein;

said housing comprises a lower portion containing an aperture traversing horizontally therethrough to allow said spring body to be inserted longitudinally through said aperture wherein said unit is sufficiently positioned at the substantial mid-point of said spring body to prevent said unit from separating from said spring body upon the striking of said spring body upon said human limb; and a dome portion covering said housing wherein said dome portion contains a decoration.

* * * * *